US006846246B2

(12) United States Patent
Asplund et al.

(10) Patent No.: US 6,846,246 B2
(45) Date of Patent: Jan. 25, 2005

(54) SLOTTED GOLF CLUB HEAD

(75) Inventors: Brad Asplund, Taylorsville, UT (US); Peter Salm, West Valley, UT (US)

(73) Assignee: Brakeout Technology, L.L.C., Taylorsville, UT (US)

( * ) Notice: Subject to any disclaimer, the term of this patent is extended or adjusted under 35 U.S.C. 154(b) by 269 days.

(21) Appl. No.: 10/082,484

(22) Filed: Feb. 25, 2002

(65) Prior Publication Data

US 2002/0173375 A1 Nov. 21, 2002

Related U.S. Application Data

(63) Continuation-in-part of application No. 29/142,206, filed on May 21, 2001, now Pat. No. Des. 459,424.

(51) Int. Cl.[7] ..... A63B 53/04
(52) U.S. Cl. ..... 473/327; 473/328; 473/350
(58) Field of Search ..... 473/324, 330, 473/331, 350, 349, 327, 328; D21/754, 755, 756, 757, 758, 759, 751, 747, 748, 749

(56) References Cited

U.S. PATENT DOCUMENTS 780,776 A 1/1905 Brown
1,089,881 A 3/1914 Taylor
2,034,936 A * 3/1936 Barnhart
3,003,768 A 10/1961 Clements
D212,293 S * 9/1968 Brown
3,719,359 A 3/1973 Evans et al.
4,065,133 A * 12/1977 Gordos
4,869,508 A 9/1989 Miller
5,000,455 A 3/1991 Beilfuss, Sr.
5,597,364 A * 1/1997 Thompson
5,762,566 A * 6/1998 King
D419,214 S 1/2000 Hamm
D459,424 S * 6/2002 Asplund
6,471,602 B1 * 10/2002 D'Orazio
6,517,449 B2 * 2/2003 Otoguro

* cited by examiner

*Primary Examiner*—Sebastiano Passaniti
(74) *Attorney, Agent, or Firm*—Workman Nydegger

(57) ABSTRACT

A slotted golf club head for reducing the obstruction of an obstacle such as sand, water, or grass when striking a golf ball. The slotted golf club head having: i.) a wide club sole that prevents the golf club head from being encumbered by the hazard or obstacle and for providing mass and a lower center of gravity for the golf club head; and ii.) a club face having a) an un-slotted upper portion adapted to provide an un-slotted striking surface for the golf ball and additional mass and balance to the golf club head; and b) a slotted lower portion having a plurality of slots for allowing an obstacle to pass through the golf club head. The slots extend from the club face through the club body. The slot bottoms of that extend through the sole allowing the slot bottoms to be straight and substantially level with the club sole.

31 Claims, 4 Drawing Sheets

SLOTTED GOLF CLUB HEAD

CROSS-REFERENCE TO RELATED APPLICATIONS

This is continuation-in-part application of U.S. Design patent application Ser. No. 29/142,206 filed May 21, 2001, now U.S. Pat. No. D459,424 and entitled "GOLF CLUB," the disclosure of which is incorporated by this reference.

BACKGROUND OF THE INVENTION

1. The Field of the Invention

The present invention relates to golf club heads. More particularly the present invention relates to a slotted golf club head adapted to reduce the impedance of an obstruction of golf course hazards, course surface, or other obstacle, such as sand, water, grass, or turf, by allowing the obstruction to pass through the golf club head.

2. The Relevant Technology

Traditional golf clubs have been developed to deal with particular situations faced by golfers on a golf course. For example, drivers have been developed to provide the force and loft needed to drive a golf ball long distances. Putters have been developed to provide the accuracy needed to make close range shots while keeping the golf ball on the ground. Irons have been developed to provide mid-range distance while dealing with a variety of circumstances faced on the golf course.

Obstructions on the golf course pose some of the most vexing circumstances faced by golfers. Obstructions can be encountered as a result of the elements or as a designed aspect of the golf course. Examples of obstructions typically encountered include sand traps, water hazards, loose grass, or mud. Few, golf clubs have been adapted to efficiently deal with such hazards. For example, the club face of a sand wedge has been developed with a 56 degree slope to loft a golf ball out of a sand trap. The stroke used to lift the golf ball out of the sand trap is referred to as an "explosion shot" due to the fact that sand is lifted out of the trap with the ball. To successfully utilize the sand wedge during the "explosion shot," the golfer must strike a position in the sand approximately two inches behind the golf ball. Even experienced golfers encounter trouble in executing the "explosion shot" with the precision needed to correctly loft the golf ball. Additionally, while the sand wedge is not particularly well adapted to deal with non-sand hazards, golfers use the sand wedge for non-sand hazards due to the absence of golf clubs adapted to deal with non-sand hazards. What is needed is a golf club head adapted to deal more efficiently with sand and non-sand hazards encountered on a golf course.

BRIEF SUMMARY OF THE INVENTION

The following is a brief description of an exemplary embodiment of the present invention. A slotted golf club head is provided for reducing the obstruction of hazards encountered when striking a golf ball. The slotted golf club head reduces the obstruction of hazards by allowing the hazards to pass through the golf club head when the hazards come in contact with the golf club head.

The slotted golf club head includes a club face adapted for striking the golf ball. The club face includes a plurality of slots extending from the club face through the golf club head. The slots are adapted to allow obstructions such as sand, water, mud, grass, or gravel to pass through the golf club head in an efficient manner.

In one embodiment of the present invention, the club face includes an un-slotted upper portion and a slotted lower portion. The un-slotted upper portion is adapted to provide an un-slotted striking surface for hitting the golf ball and additional strength, mass, and balance to the golf club head. In one embodiment, the un-slotted upper portion covers at least one fifth of the total area of the club face.

The slotted lower portion includes a plurality of slots and a plurality of contacting portions. The slots allow obstructions to pass through the club face while the contacting portions provide a striking surface for hitting the golf ball. The slots include slot bottoms configured to be flat and level to allowing obstructions to pass through the slots without obstruction from the slot bottoms.

In another embodiment, a wide solid sole is provided for preventing the golf club head from being encumbered by an obstruction. Additionally, the sole provides mass, balance, and a lower center of gravity to the golf club head. In one embodiment of the present invention, the weight removed from the club face by the slots is replaced in the sole of the club. This provides a lower center of gravity to the golf club head, creating a higher trajectory, thus lofting the golf ball more quickly out of a sand trap or other obstacle or hazard. In one embodiment of the present invention, the slot bottoms pass through the sole. By allowing the slot bottoms to pass through the sole, the slot bottoms can be made flat and level, thus allowing obstructions to efficiently pass through the golf club head.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
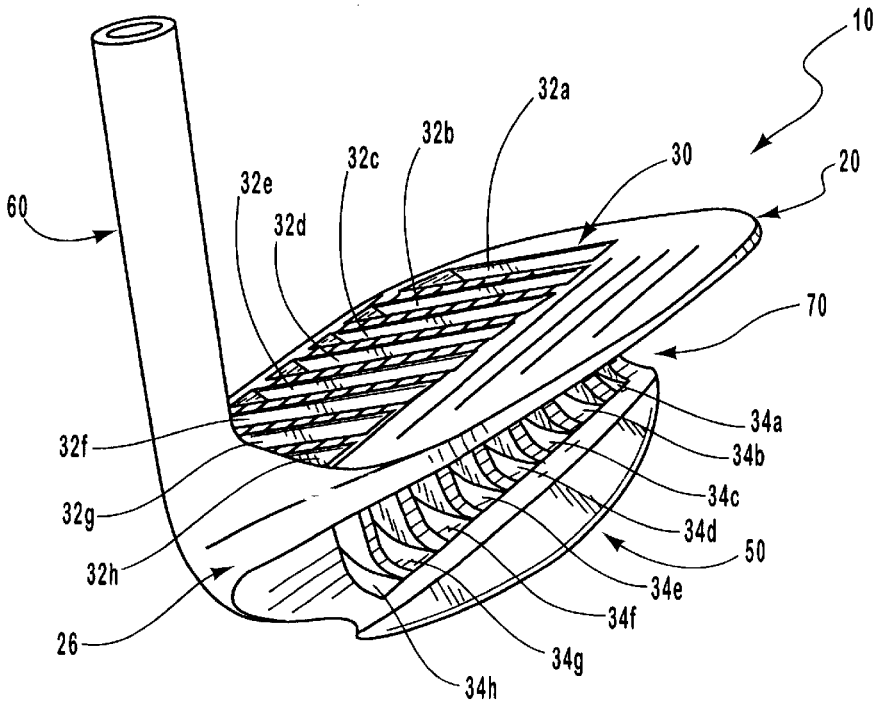
FIG. 1 is a perspective view of an exemplary embodiment of the golf club head of the present invention.

With reference to FIG. 1, there is shown a perspective view of an exemplary embodiment of the golf club head 10 of the present invention. Golf club head 10 is adapted to reduce the impedance of an obstruction that can be encountered when striking a golf ball. Examples of obstacles, hazards, and obstructions typically encountered on a golf course include, but are not limited to, sand, water, grass, turf, mud, and the like. In the present invention, when an obstruction, hazard, or obstacle comes in contact with the golf club head, some, or all, of the impedance is eliminated by allowing the obstruction to flow through the slots of the golf club face. By eliminating some, or all, of the obstruction caused by the obstruction, the golf club head 10 can slide through the obstruction with less impedance, thus providing greater force when striking the golf ball.

The golf club head 10 includes a club face 20, a club body 26, a sole 50, a shank 60, and a cavity back 70. Club face 20 is positioned at the front portion of golf club head 10 and is adapted to strike a golf ball. Club face 20 comprises a slotted lower portion 30 and an un-slotted upper portion 40. Slotted lower portion 30 includes a plurality of slots 32*a–h* and a plurality of contacting portions 36*a–g*. Contacting portions 36*a–g* are configured to provide a slotted striking surface for hitting the golf ball. Slots 32*a–h* are configured to allow an obstruction, hazard, or obstacle coming in contact with slotted lower portion 30 to pass through golf club head 10. While the illustrated embodiment depicts eight slots and seven contacting portions lying perpendicular leading edge 22 of the club face 20, a variety of numbers of slots and contacting portions can be utilized within the scope and spirit of the present invention. For example, the slots could lie horizontally or diagonally with respect to leading edge 22 or club face 20. With continued reference to slots 32*a–h*, FIG. 1 also depicts slot bottoms 34*a–h*. The slot bottoms will be discussed in greater detail with reference to FIG. 3.

Un-slotted upper portion 40 of club face 20 is positioned above slotted lower portion 30 of club face 20. Un-slotted upper portion 40 is adapted to provide an un-slotted striking surface for hitting the golf ball. By including both a slotted lower portion 30 and an un-slotted upper portion 40, club face 20 benefits from the design benefits of both a traditional club face and a slotted club face. Slotted lower portion 30 allows obstructions such as sand, water, gravel, grass, or the like to pass through golf club head 20. Un-slotted upper portion 40 provides a traditional un-slotted surface for striking the golf ball. Additionally, un-slotted upper portion 40 provides additional strength, mass, and balance to club face 20 and golf club head 10 as a whole. This provides a more solid striking surface irrespective of whether the golf ball is struck by slotted lower portion 30 or un-slotted upper portion 40 of club face 20. Club body 26 of golf club head 10 provides mass, strength, and a lower center of gravity to golf club head 10. Slots 32*a–h* extend from club face 20 through club body 26.

Sole 50 is positioned on the bottom portion of golf club head 10. Sole 50 extends from club face 20 to the rear portion of golf club head 10. Sole 50 prevents golf club head 10 from being encumbered by a hazard or obstacle by keeping golf club head 10 from excessively penetrating the hazard or obstacle. For example, the wide solid configuration of sole 50 acts to prevent golf club head 10 from excessively digging into sand, turf, or other golf course hazards or obstacles.

Sole 50 also provides mass and a lower center of gravity to golf club head 10. The wide solid configuration of sole 50 also allows weight to be distributed in the portion of the club body 26 contiguous with sole 50. By distributing the weight across the bottom of golf club head 10, balance and a center of gravity is imparted to golf club head 10. In one embodiment of the present invention, the weight removed from the club face is replaced in the sole 50. Moving the weight to the sole 50 creates a lower center of gravity creating a higher trajectory, thus lofting the golf ball more quickly from a hazard or obstacle. Moving the weight to the sole 50 also allows the total weight of the golf club head 10 to remain consistent with a typical iron or wedge.

Shank 60 is coupled to club body 26 at one side of golf club head 10. Shank 60 provides a mechanism for attaching a shaft to golf club head 10. The shaft can be coupled with a handle allowing the user to grip and swing the golf club. Club shank 60 can be connected to club body 26 by a variety methods and in a variety of configurations without departing from the scope or spirit of the present invention.

FIG. 1 also illustrates a cavity back 70 according to one embodiment of the present invention. Cavity back 70 allows mass to be distributed to sole 50 imparting balance and a lower center of gravity to sole 50 of golf club head 10. Cavity back 70 will be discussed in greater detail with reference to FIGS. 4 and 5.

Figure 2:
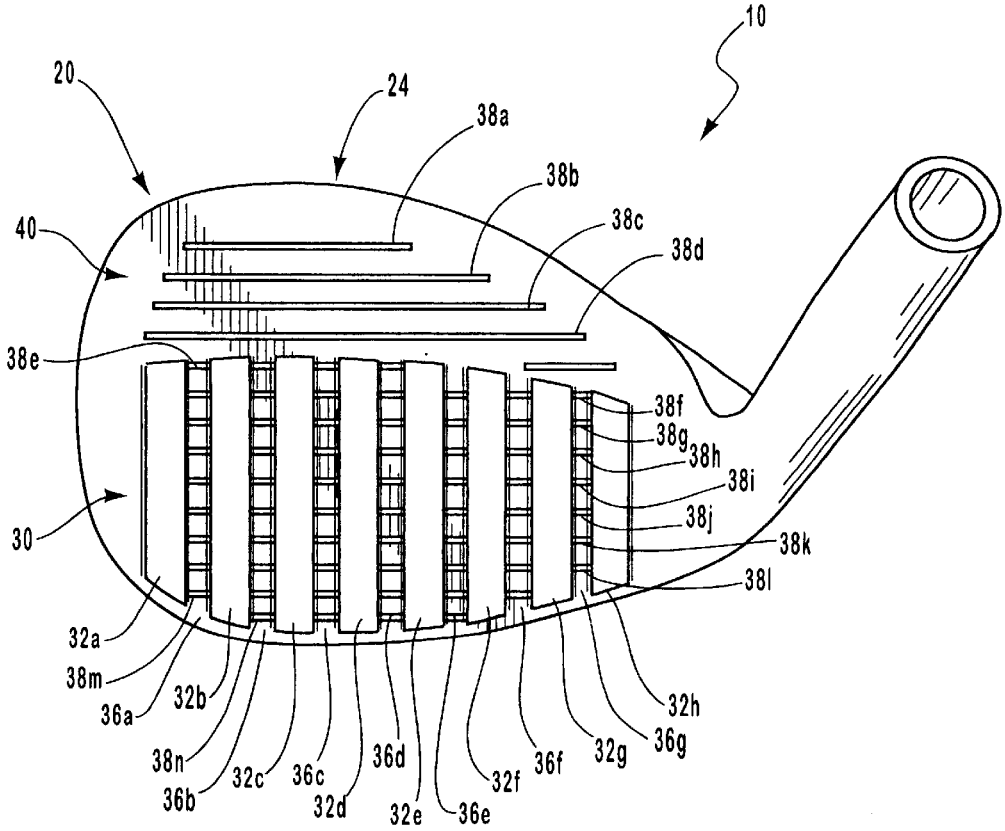
FIG. 2 is a front view of an exemplary embodiment of the golf club head illustrating the club face and the slots.

With reference now to FIG. 2, there is shown a front view of an exemplary embodiment of the golf club head illustrating club face 20 in greater detail. Club face 20 comprises a leading edge 22, a rear edge 24, a slotted lower portion 30, a un-slotted upper portion 40, and grooves 38*a–n*. In the illustrated embodiment, slotted lower portion 30 of club face 20 includes slots 32*a–h*. The front edges of slots 32*a–h* are approximately equidistant from leading edge 22 of club face 20. The front edges of slots 32*a–h* follow the contour of the leading edge 22. Similarly, the top edges of slots 32*a–h* are contoured respectively to the rear edge 24 to allow a largely uniform contact area across un-slotted upper portion 40 of club face 20. In the illustrated embodiment, the top edges of slots 32*a–h* do not exactly follow the contour of rear edge 24 of club face 20. Rather, the contour of the top edges of slots 32*a–h* is somewhat attenuated to maintain a more gradual change in the slot height of adjacent slots (see e.g. slots 32*e–h*).

Due to the curved nature of leading edge 22 and rear edge 24 of club face 20, the height of the slots 32*a–h* vary. For example, in the illustrated embodiment, the height of the slots positioned in the middle portion of club face 20 (i.e. 32*c–e*) is greater than the height of the slots positioned on the edges of club face 20 (i.e. 32*a* and 32*h*). Slots 32*a–h* can take on a variety of configurations and a variety of forms without departing from the scope or spirit of the present invention. For example, in one embodiment, slots 32*a–h* are of a uniform height. In yet another embodiment, the front edge of the slots form a straight line rather than being equidistant from the curved leading edge 22 of club face 20.

The illustrated embodiment also depicts contacting portions 36*a–h*. The contacting portions 36*a–h* provide a striking surface for hitting the golf ball. In one embodiment, the edges of contacting portions 32*a–h* are attenuated to prevent scoring of the golf ball when one or more of the edges of contacting portions 32*a–h* strike the golf ball. There are a variety of types of attenuated edges that can be utilized including, but not limited to, champed edges, beveled edges, or rounded edges.

Contacting portions 32*a–h* are to a large extent defined by the appurtenant slots. For example, the height of contacting portions 32*a–h* are defined by the height of slots 32*a–h*. In the illustrated embodiment, the height of contacting portions 36*a–h* vary due to the variation in the height of slots 32*a–h*. In an alternative embodiment, the height of the contacting portions are uniform based on the uniformity of the slots provided in the embodiment.

Similarly, the width of contacting portions 36*a–g* is defined by the width of slots 32*a–h*. In the illustrated embodiment, the width of the contacting portions 36*a–h* is narrower than the width of slots 32*a–h*. In the preferred embodiment, the width of slots 32*a–h* is a uniform 0.19 inches while the width of the contacting portions is a uniform 0.13 inches. In alternative embodiments of the present invention, a variety of widths for both slots 32*a–h* and contacting portions 36*a–g* can be utilized. However, it is preferred that the number and the width of slots and contacting portions be such that slotted lower portion 30 of club face 20 provide an accurate striking surface irrespective of the exact spot the golf club contacts the club face 20. As will be appreciated by those skilled in the art, the width and relationship of the plurality of slots and plurality of contacting portions can vary without departing from the scope or spirit of the present invention. For example, the width of contacting portions 36*a–g* can be greater than the width of slots 32*a–h*. In an alternative embodiment, the width of slots 32*a–h* and/or of contacting portion 36*a–g* can vary.

In the illustrated embodiment, un-slotted upper portion 40 of club face 20 is shown in greater detail. Un-slotted upper portion 40 is adapted to provide an un-slotted striking surface for the golf ball and additional mass and balance to golf club head 10. In our preferred embodiment un-slotted upper portion 40 comprises at least one fifth of the total area of club face 20. Depending on the height of club face 20, un-slotted upper portion 40 will preferably comprise between 0.45 and 1.6 inches of club face 20. By covering at least one fifth of the total area of club face 20, un-slotted upper portion 40 provides sufficient contact area for striking a golf ball while also providing mass, strength, and balance to the entire club face 20. Because the slots 32*a–h* of slotted lower portion 30 tend to weaken the club face and lessen the energy transferred to the golf ball, the additional strength and mass added by un-slotted upper portion 40 contributes to the overall performance of golf club head 10.

With reference now to grooves 38*a–n* depicted in FIG. 2. Grooves 38*a–n* are designed to promote backspin and loft on a golf ball struck by club face 20. Grooves 38*a–n* can be grouped into upper grooves 38*a–d* and lower grooves 38*e–n*. Upper grooves 38*a–d* are provided in un-slotted upper portion 40 of club face 20. Lower grooves 38*e–n* are provided in slotted lower portion 30 of club face 20. In the illustrated embodiment, upper groves 38*a–d* are configured to form unbroken straight lines across un-slotted upper portion 40 of club face 20. Due to the presence of slots 32*a–h* on slotted lower portion 30, lower grooves 38*e–n* are configured to be positioned intermittently across slotted lower portion 30 of club face 20. The even distance between lower grooves 38*e–n* on contacting portions 36*a–g* creates imaginary straight lines across slotted lower portion 30 similar to upper grooves 38*a–d*. The particular number and configuration of the grooves of club face 20 is not limited to those illustrated in FIG. 2. For example, the grooves can be provided for only a portion of club face 20. Alternatively, the grooves can be curved or circular in nature.

Figure 3:
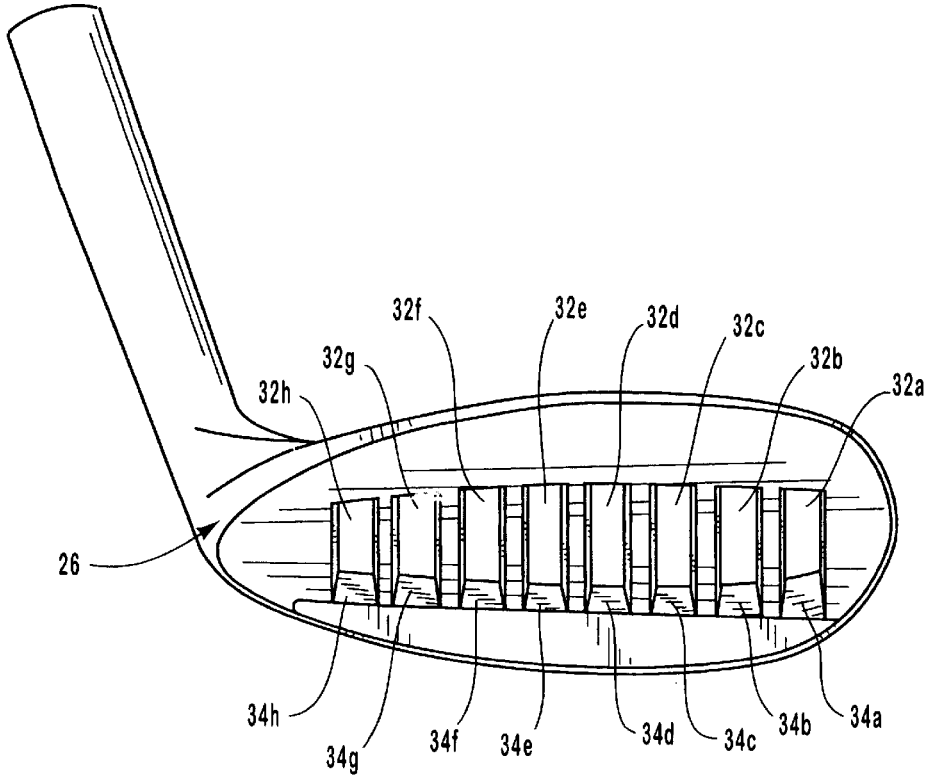
FIG. 3 is a rear view of the golf club head in an exemplary embodiment of the present invention illustrating the slots and the slot bottoms.

FIG. 3 is a rear view of an exemplary embodiment of golf club head 10 illustrating slots 32*a–h*. In one embodiment of the present invention, the width of the slots 32*a–h* varies as the slots 32*a–h* progress through the club body 26. The variation in the width can be a very incremental draft, or a more perceptible variation. In both scenarios, design benefits to the golf club head 10 are imparted to the club. Examples of the design benefits will be discussed in greater detail below with reference to various embodiments of slots 32*a–h*. In the illustrated embodiment, slots 32*a–h* are narrowest at club face 20 and progressively widen as the slots progress through club body 26. By providing slots that are wider at the rear of the slots than at club face 20, obstructions such as sand, mud, or turf can more easily pass through golf club head 10 without becoming lodged in slots 32*a–h*.

In an alternative embodiment of the present invention, slots 32*a–h* are wider at club face 20 than at the rear of the slots. By providing slots that are wider at club face 20 than at the rear of the slots, golf club head 10 allows a wider slot entrance for sand, water, mud, grass, turf or other obstructions thus allowing the obstacle to more easily enter the slots. Additionally, by providing a narrowing of slots 32*a–h*, the portions of club body 26 on either side of the slots are wider, thus providing additional strength to contact portions 36*a–g*. This also allows contact portions 36*a–g* to impart more force to the golf ball. Additionally, the draft angle allows golf club head 10 to be more easily and inexpensively manufactured by allowing a single manufacturing member, such as a mold, to be removed from the front of the club rather than requiring multiple manufacturing members to create the slots.

The illustrated embodiment also depicts slot bottoms 34*a–h* of slots 32*a–h*. Slot bottoms 34*a–h* extend through the portion of club body 26 contiguous with sole 50. Because the portion of golf club head 10 contiguous with sole 50 is substantially wider than the portion of golf club head 10 contiguous with the top of the slots, the bottom of the slots 34*a–h* are more than twice as long as the slot tops (not shown). Additionally, by extending slots 32*a–h* through sole 50, slot bottoms 34*a–h* are substantially level with sole bottom 52 such that the angle formed by the slot bottoms 34*a–h* and the club face 20 is approximately 30 degrees in the preferred embodiment. While the angle between the slot bottoms 34*a–h* and the club face 20 is approximately 30 degrees in the preferred embodiment, the particular configuration of the slot bottoms 34*a–h* with reference to the club face can vary without departing from the scope or spirit of the present invention. For example, the angle between the slot bottoms 34*a–h* and the club face 20 can vary between 25 and 60 degrees and continue to realize many of the design benefits of having slot bottoms 34*a–h* that are substantially level with the sole bottom 52.

While the sole bottom 52 is cambered in the preferred embodiment, the slot bottoms 34*a–h* are flat. By utilizing a level, flat configuration of slot bottoms 34*a–h* obstructions such as sand, water, gravel, grass, or turf can more easily pass through golf club head 10. This allows an obstacle to more easily pass through golf club head 10, thus reducing the obstruction from obstructions blocking the path of the golf ball. By reducing the obstructions blocking the path of the golf ball, golf club head 10 can strike the golf ball with less obstruction and transfer more energy to the golf ball.

Figure 4:
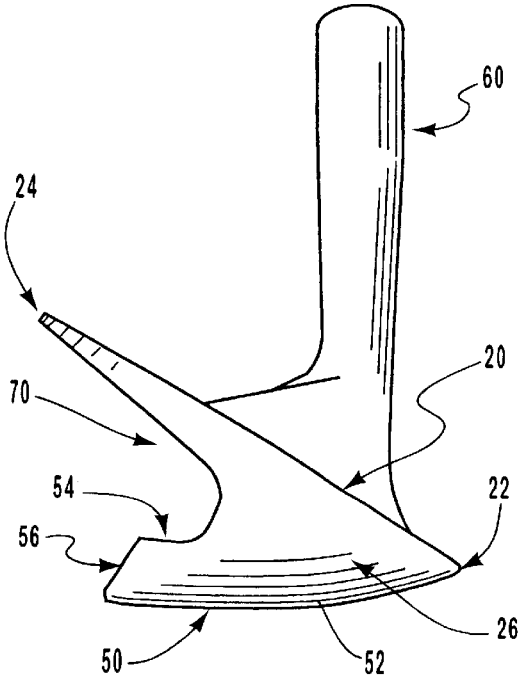
FIG. 4 is a side view illustrating an exemplary embodiment of the sole portion of the golf club head.
Figure 5:
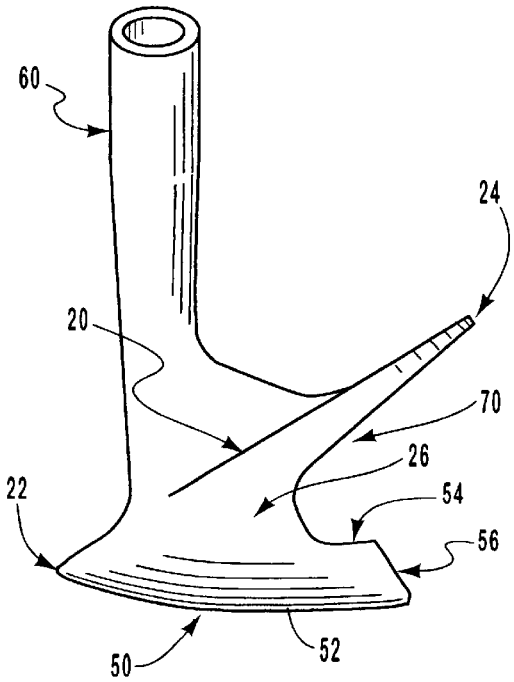
FIG. 5 is a side view illustrating an exemplary embodiment of the golf club head from the shank side of the golf club head.

FIGS. 4 and 5 provide a side view of an exemplary embodiment of golf club head 10 illustrating sole 50 of golf club head 10. FIG. 4 is a side view illustrating an exemplary embodiment of golf club head 10 from the side of golf club head 10 opposite shank 60. FIG. 5 is a side view illustrating the exemplary embodiment of golf club head 10 from the shank side of golf club head 10. In the illustrated embodiment, sole 50 extends from leading edge 22 of club face 20 to the rear of golf club head 10. Sole 50 prevents the golf club head 10 from being encumbered by hazards or obstacles by providing a wide bottom surface that prevents golf club head 10 from excessively penetrating the hazard or obstacle during the swing of the golf club. Additionally, sole 50 provides mass and a lower center of gravity for balancing golf club head 10. The additional mass provided by sole 50 is helpful to compensate for the weight removed from club head 10 by slots 32*a–h*. Moving the weight to sole 50 creates a lower center of gravity creating a higher trajectory, thus providing a greater loft to the golf ball out of a hazard or over an obstacle. Sole 50 comprises a sole bottom 52, a rear portion 54, and a ramp 56.

Sole bottom 52 provides for a wide solid surface that prevents club head 10 from excessively penetrating a hazard or obstacle during the swing. By providing a wide solid configuration to the sole bottom 52, mass can be distributed across the bottom of the golf club head 10 providing balance to golf club head 10. In one preferred embodiment, sole bottom 52 is cambered to reduce the drag from sand, water, grass or turf.

With reference now to rear portion 54 of sole 50. Rear portion 54 is contiguous with the back portion of slots 32*a–h*. The substantially straight design of rear portion 54 allows obstructions passing through slots 32*a–h* to pass easily over sole 50. Rear portion 54 of sole 50 also defines the bottom of cavity back 70. By utilizing a cavity back 70 instead of a solid back, mass and balance are imparted to sole 50. By allowing mass to be imparted to the sole 50, the cavity back permits sole bottom 52 to be wider and sole 50 to have more mass. As previously discussed, the wide solid configuration of sole bottom 52 prevents golf club head 10 from being encumbered by a hazard or obstacle.

Ramp 56 of sole 50 is adapted to allow obstructions passing through slots 32*a–h* to slide easily off golf club head 10. Additionally, the diagonal nature of ramp 56 provides a means for fine-tuning the weight of sole 50. By permitting fine-tuning of the weight of sole 50, a desired swing weight can be achieved while maintaining the maximum surface area on sole bottom 52.

Figure 6:
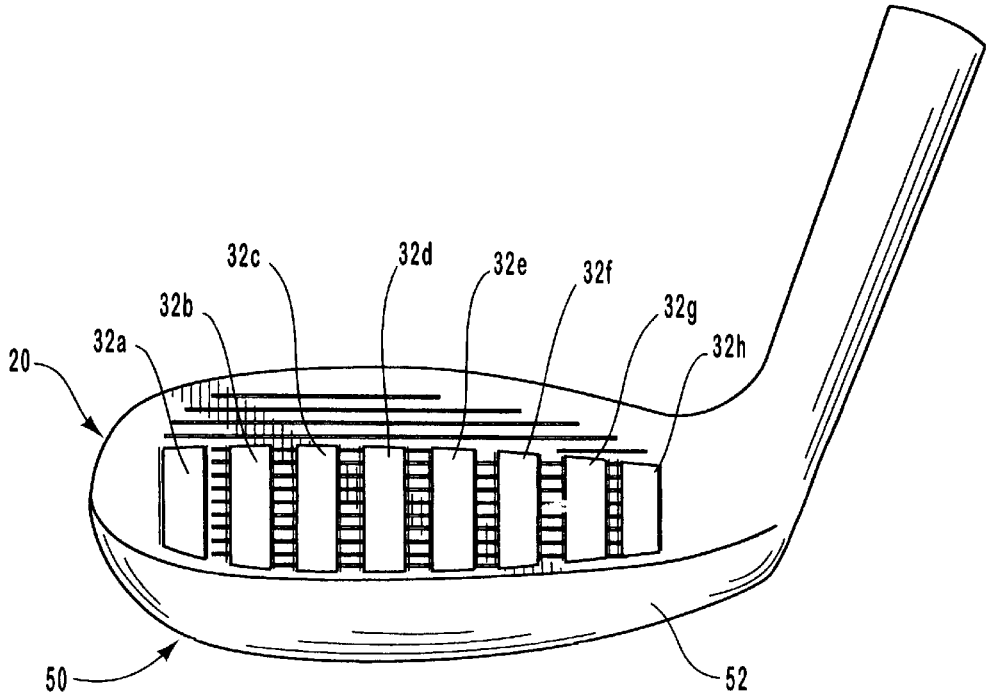
FIG. 6 is a perspective view illustrating the club face and the sole of the golf club head in an exemplary embodiment of the present invention.

FIG. 6 is a perspective view showing an embodiment of golf club head 10 having both a slotted club face 20 and wide sole 50. By providing both a slotted club face 20 and a club sole 50 having a wide solid configuration, golf club head 10 can reduce the obstruction of a hazard or obstacle when striking the golf ball. As previously discussed, sole 50 is configured to prevent golf club head 10 from penetrating a hazard such as sand or water. Thus when golf club head 10 enters the hazard, the vast majority of the sand or water remains below golf club head 10.

Slots 32*a–h* allow the obstructions lying between the ball and club face 20 to pass through golf club head 10. By providing both slots 32*a–h* on club face 20 and club sole 50, golf club head 10 can more effectively reduce the impedance of an obstruction when striking the golf ball. Additionally, slots 32*a–h* are configured to assist in squaring the golf club head 10 during a swing. When golf club head 10 strikes an obstruction, sand for example, the golf club head 10 has a propensity to flow through the obstruction along the path of least resistance. The configuration of slots 32*a–h* is such that the path of least resistance corresponds to a path in which the club face 20 is square with the golf ball when the golfer's stance is square with the golf ball.

Figure 7:
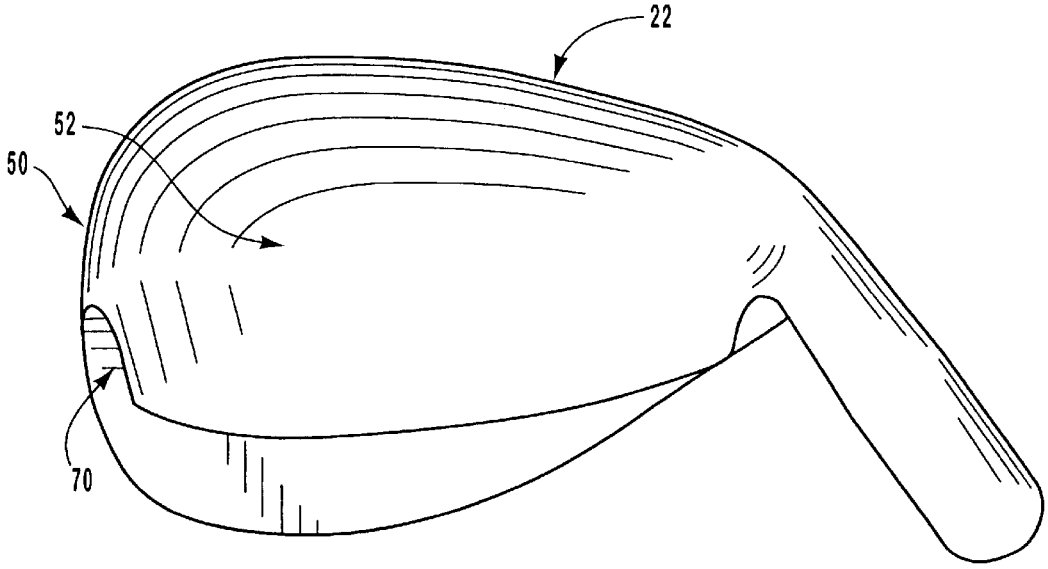
FIG. 7 is a bottom view illustrating one embodiment of the sole of the golf club head having a cambered configuration.
Figure 8:
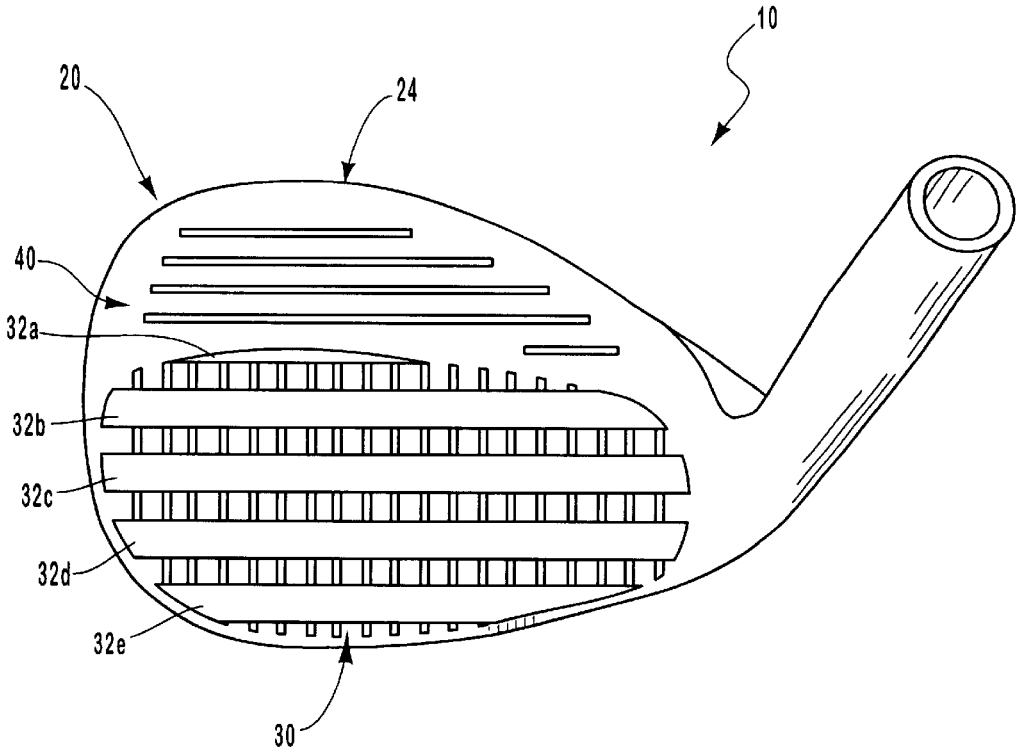
FIG. 8 is a front view of an alternative embodiment of the golf club head.
Figure 9:
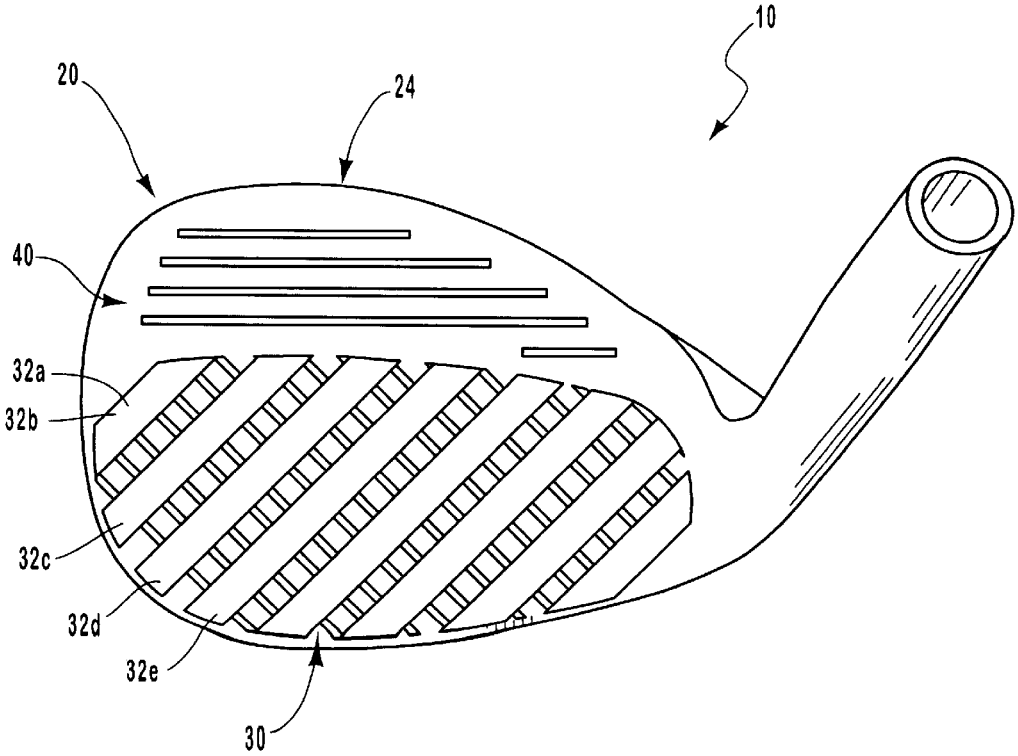
FIG. 9 is a front view of an alternative embodiment of the golf club head.

FIG. 7 is a bottom view showing the cambered configuration of sole 50 of one embodiment of golf club head 10. There is also shown in FIG. 7 a bottom perspective of back cavity 70 and leading edge 22 for orientation. It can be seen that sole bottom 52 of sole 50 provides a wide solid surface for preventing golf club head 10 from being encumbered by a hazard, obstruction, or obstacle. The cambered configuration of sole 50 reduces the drag of a hazard, obstruction, or obstacle such as sand, water, grass, or turf when the obstruction is contacted by golf club head 10. By reducing the drag of the hazard, obstruction, or obstacle, the cambered configuration of sole 50 allows golf club head 10 to maintain its balance during the swing. The golf club head 10 can thus strike the golf ball in a more predictable and uniform manner.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A golf club head for use in connection with a golf ball, the golf club head comprising:

a club face adapted for striking the golf ball, said club face having a leading edge, an un-slotted upper portion, and a lower portion having a plurality of slots wherein said slots have a slot bottom and a slot top and wherein said plurality of slots extend from said lower portion of said club face through the golf club head; and a sole extending from said leading edge of said club face to a rear portion of the golf club head wherein said sole has a sole bottom that prevents the golf club head from being encumbered by an obstruction and wherein said plurality of slots extend through the golf club head such that said slot bottoms are more than twice as long as said slot tops.

2. The golf club head of claim 1, wherein said obstruction comprises sand.

3. The golf club head of claim 1, wherein said obstruction comprises water.

4. The golf club head of claim 1, wherein said obstruction comprises turf.

5. The golf club head of claim 1, wherein said obstruction comprises grass.

6. The golf club head of claim 1, wherein said sole is chamfered to reduce the drag of said obstruction.

7. The golf club head of claim 1, wherein said sole provides additional mass to the golf club head.

8. The golf club head of claim 1, wherein said sole provides a lower center of gravity to the golf club head.

9. The golf club head of claim 1, wherein said sole includes a ramp on a rear portion of said sole.

10. The golf club head of claim 9, wherein said ramp allows sand to slide off said rear portion of said sole.

11. The golf club head of claim 9, wherein said ramp provides mass for achieving a desired swing weight.

12. A golf club head for reducing the obstruction of an obstruction when striking a golf ball, the golf club head comprising:

(a) a club face adapted for striking the golf ball, said club face comprising;

(i) an un-slotted upper portion adapted to provide an un-slotted striking surface for the golf ball and additional strength, mass, and balance to the golf club head wherein said un-slotted upper portion comprises at least one fifth of the total area of said club face;

(ii) a slotted lower portion having a plurality of contacting portions, wherein said slotted lower portion is configured to provide a slotted striking surface for hitting the golf ball and to allow the obstruction to pass through the golf club head; and (iii) a leading edge positioned at the bottom of said slotted lower portion of said golf club face; and (b) a sole extending from said leading edge of said club face to a rear portion of the golf club head wherein said sole has a sole bottom that prevents the golf club head from being encumbered by the obstruction and wherein said sole provides mass and a lower center of gravity for balancing the golf club head; and (c) a plurality of slots having slot bottoms and slot tops wherein said plurality of slots extend from said slotted lower portion of said club face through the golf club head wherein said slotted lower portion of said slots extend through said sole such that said slot bottoms are more than twice as long as said slot tops and wherein the width of said slots changes from said club face to said rear portion of the golf club head.

13. The golf club head of claim 12, wherein said slots at said club face have a width of 0.182 inch.

14. The golf club head of claim 12, wherein said contacting portions have a width of 0.130 inch.

15. The golf club head of claim 12, wherein the width of said slots and said contacting portions vary.

16. The golf club head of claim 12, wherein said un-slotted upper portion of said club face comprises between 0.45 inch and 1.2 inch of the total of said club face.

17. The golf club head of claim 12, wherein said plurality of slots are equidistant from said leading edge of said club face.

18. A golf club comprising:

a club shaft adapted to allow a user to grip the golf club; and a club head disposed at the distal end of said club shaft, said club head being adapted to hit a golf ball, said club head further comprising:

a club face for striking said golf ball, said club face having a leading edge, an un-slotted upper portion covering at least one fifth of the club face, and a slotted lower portion having a plurality of contacting portions;

a club body providing mass and a lower center of gravity to said club head; and a club sole extending from said leading edge of said club face, said club sole having a sole bottom adapted to prevent said club head from penetrating excessively into a hazard or obstacle during the swing of the golf club, and a plurality of slots having slot bottoms and slot tops wherein said plurality of slots extend from said lower portion of said club face through said club body, wherein said plurality of slots extend through said club sole such that said slot bottoms are more than twice as long as said slot tops.

19. The golf club of claim 18, wherein said plurality of slots comprise between 5–25 slots.

20. The golf club of claim 18, wherein the plurality of slots comprise 8 slots.

21. The golf club of claim 18, wherein the width of said plurality of slots exceeds the width of said contacting portions.

22. The golf club of claim 18, wherein the width of said plurality of slots is less than the width of said contacting portions.

23. The golf club of claim 18, wherein the each of said plurality of contacting portions have edges bounded by said slots.

24. The golf club of claim 23, wherein said edges are chamfered to prevent scoring of said golf ball.

25. The golf club of claim 23, wherein said edges are beveled to prevent scoring of said golf ball.

26. The golf club of claim 18, wherein the height of said plurality of slots varies.

27. The golf club of claim 18, wherein the height of said slots positioned in the middle portion of the club face is greater than height of said slots positioned at said edges of said club face.

28. The golf club of claim 18, wherein said slots are perpendicular with said leading edge of said club face.

29. The golf club of claim 18, wherein said slots are not perpendicular with said leading edge of said club face.

30. The golf club of claim 18, wherein said slots are horizontal with said leading edge of said club face.

31. The golf club of claim 18, wherein said slots are diagonal with said leading edge of said club face.

* * * * *